US006684861B2

(12) United States Patent
Reiter

(10) Patent No.: US 6,684,861 B2
(45) Date of Patent: Feb. 3, 2004

(54) FIXING DEVICE

(75) Inventor: Ferdinand Reiter, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,623

(22) PCT Filed: Feb. 22, 2002

(86) PCT No.: PCT/DE02/00645

§ 371 (c)(1),
(2), (4) Date: Mar. 19, 2003

(87) PCT Pub. No.: WO02/066827

PCT Pub. Date: Aug. 29, 2002

(65) Prior Publication Data

US 2003/0164158 A1 Sep. 4, 2003

(30) Foreign Application Priority Data

Feb. 22, 2001 (DE) ..... 101 08 467

(51) Int. Cl.[7] ..... F02M 37/04
(52) U.S. Cl. ..... 123/470; 123/456; 285/162
(58) Field of Search ..... 123/470, 456, 123/468, 469, 509; 239/600; 285/149.1, 151.1, 382.7, 162, 46, 179, 305, 319, 281

(56) References Cited

U.S. PATENT DOCUMENTS

| | | | | | |
|---|---|---|---|---|---|
| 3,762,173 | A | | 10/1973 | Marsh | |
| 4,474,160 | A | | 10/1984 | Gartner | |
| 4,829,965 | A | * | 5/1989 | Gartner et al. | 123/470 |
| 4,982,983 | A | * | 1/1991 | Lenzi et al. | 285/281 |
| 5,501,195 | A | * | 3/1996 | Hall | 123/470 |
| 5,634,673 | A | * | 6/1997 | Miyazaki et al. | 285/162 |
| 5,893,351 | A | * | 4/1999 | Akutagawa et al. | 123/470 |
| 5,970,953 | A | * | 10/1999 | Lorraine et al. | 123/470 |
| 6,019,089 | A | * | 2/2000 | Taylor et al. | 123/470 |
| 6,148,797 | A | * | 11/2000 | Gmelin | 123/456 |
| 6,276,339 | B1 | * | 8/2001 | Shebert et al. | 123/470 |
| 6,431,151 | B1 | * | 8/2002 | Gmelin | 123/470 |
| 6,481,420 | B1 | * | 11/2002 | Panasuk et al. | 123/470 |

FOREIGN PATENT DOCUMENTS

| | | |
|---|---|---|
| DE | 29 26 490 | 9/1998 |
| DE | 100 37 497 | 4/2001 |

* cited by examiner

*Primary Examiner*—Carl S. Miller
(74) *Attorney, Agent, or Firm*—Kenyon & Kenyon

(57) ABSTRACT

A mounting device for reciprocally securing a fuel injector in a cylinder head of an internal combustion engine and the fuel injector to a fuel distribution line is designed in the form of a holding-down sleeve. At an end of the holding-down sleeve facing the fuel distribution line, at least one first elastic tongue is provided which is bent against a flow direction of the fuel, and at an end of the holding-down sleeve facing away from fuel distribution line, at least one second elastic tongue is provided which is bent in a flow direction of the fuel.

10 Claims, 2 Drawing Sheets

2/2

FIXING DEVICE

FIELD OF THE INVENTION

The present invention relates to a mounting device for securing a fuel injector in a cylinder head of an internal combustion engine, and for connecting the fuel injector to a fuel distribution line.

BACKGROUND INFORMATION

German Patent No. 29 26 490 describes a mounting device for mounting a fuel injector on an intake manifold, which axially attaches the fuel injector to the fuel distribution line or to a plug nipple by using a mounting element designed as a U-shaped clamp having two legs which are elastic in the radial direction. In the assembled state, the clamp reaches through corresponding recesses of the plug nipple and can be snapped in a recess in a connection fitting of the fuel injector, the recess being designed as a ring groove. The axial clearances between the recesses and the clamp as well as between the ring groove and the clamp are kept small, in order to achieve accurate fixation of the fuel injector without stresses on the gasket.

The stressing effect of the different mounting parts on the fuel injector is a particular disadvantage of the mounting device described in German Patent No. 29 26 490. The power flow generated in the fuel injector results in deformations and thus to changes in the lift of the valve needle including jamming, as well as in a pressure and bending strain of the housing parts, which are generally thin-walled and welded together at several points. In addition, any fixation measure, e.g., the use of a bearing collar, results in an enlargement of the radial dimension of the fuel injector and thus in an increase in required space for mounting.

SUMMARY OF THE INVENTION

The mounting device for a fuel injector according to the present invention has the advantage over the related art that the fuel injector is held down by an elastic steel sleeve having elastic tongues that is clamped between the fuel injector and the fuel distribution line, and therefore no attachment of the fuel injector to the cylinder head is used. Due to the elastic tongues, which are bent opposite one another, the mounting device provides for the transfer of the holding-down force of the fuel distribution line onto the fuel injector.

It is advantageous in particular that the mounting device as well as the elastic tongues are easily manufacturable by sheet metal stamping. Manufacture by deep-drawing and stamping is also possible.

Advantageously, screws or tension claws for mounting at the front of the cylinder head are not needed when using the mounting device according to the present invention.

Furthermore, it is an advantage that the bending of the elastic tongues, formed by stamping from the holding-down sleeve, corresponds to the curvature of the holding-down sleeve. The elastic tongues may be bent inwards by approx. 90°, thereby achieving an optimum spring effect.

DETAILED DESCRIPTION

Figure 1:
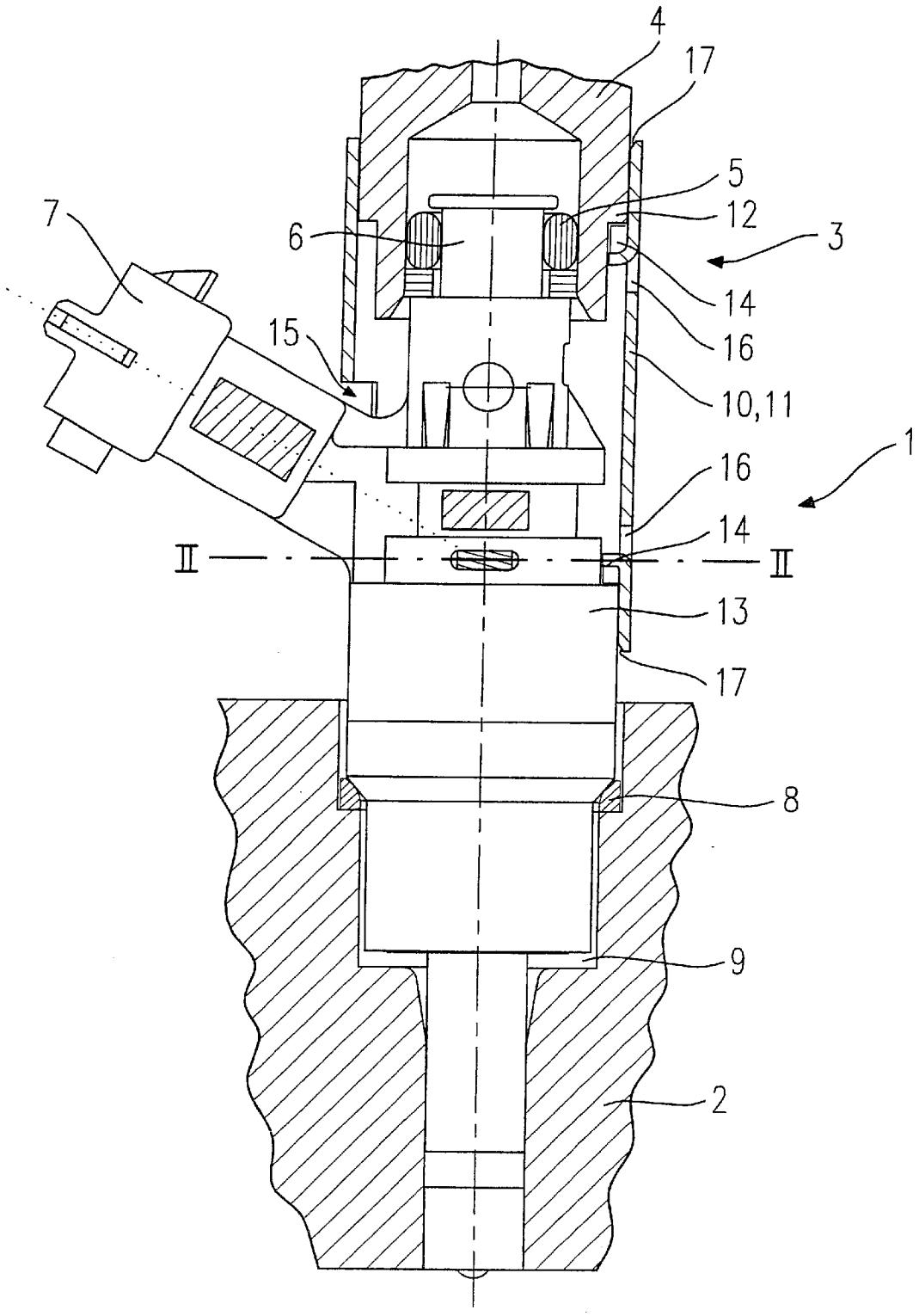
FIG. 1 shows a schematic, partly sectional view of an exemplary embodiment of a device for mounting a fuel injector on a fuel distribution line, designed according to the present invention.

FIG. 1 shows a schematic partial section through an exemplary embodiment of a device for mounting a fuel injector on a fuel distribution line, designed according to the present invention.

A fuel injector 1 designed in the form of a direct injecting fuel injector 1 is mounted in a cylinder head 2 for direct injection of fuel into a combustion chamber of a mixture-compressing, spark-igniting internal combustion engine (not illustrated). Fuel injector 1 has at an upstream end 3 a plug-in connection to a connection fitting of a fuel distribution line 4, which is sealed by a gasket 5 between fuel distribution line 4 and a supply fitting 6. Fuel injector 1 has an electrical terminal 7 for electrical contacting for actuation of fuel injector 1.

Fuel injectors has an intermediate ring 8 in a receiving bore 9 of cylinder head 2, the intermediate ring serving as a support for fuel injector 1 in receiving bore 9. Intermediate ring 8 is made of elastic material and provides for centering of fuel injector 1 in receiving bore 9.

In order to secure fuel injector 1 in receiving bore 9 of cylinder head 2, a mounting device 10 is provided according to the present invention. Mounting device 10 includes a holding-down sleeve 11 which is supported by a shoulder 12 of fuel distribution line 4 and a shoulder 13 of fuel injector 1. Holding-down sleeve 11 may be stamped out of spring steel sheet. Several elastic tongues 14 are also stamped out of holding-down sleeve 11, the elastic tongues being connected to holding-down sleeve 11 and thereby providing an elastic restraint of holding-down sleeve 11 between both shoulders 12 and 13. A detailed illustration of holding-down sleeve 11 may be seen in FIGS. 2 and 3, and the following description.

In the area of electrical terminal 7, holding-down sleeve 11 has a recess 15, which provides for an easier installation of mounting device 10. Recess 15, which runs only over 75° of the circumference, for example, has no effect on the reliability of mounting device 10, because of holding-down sleeve 11 being made from a spring steel sheet.

Holding-down sleeve 11 may have insertion bezels 17 at each end, which are formed by a bevel at a radial inner side of holding-down sleeve 11. This facilitates sliding of holding-down sleeve 11 onto fuel injector 1, as well as sliding of the connection fitting of fuel distribution line 4 into holding-down sleeve 11.

Figure 2:
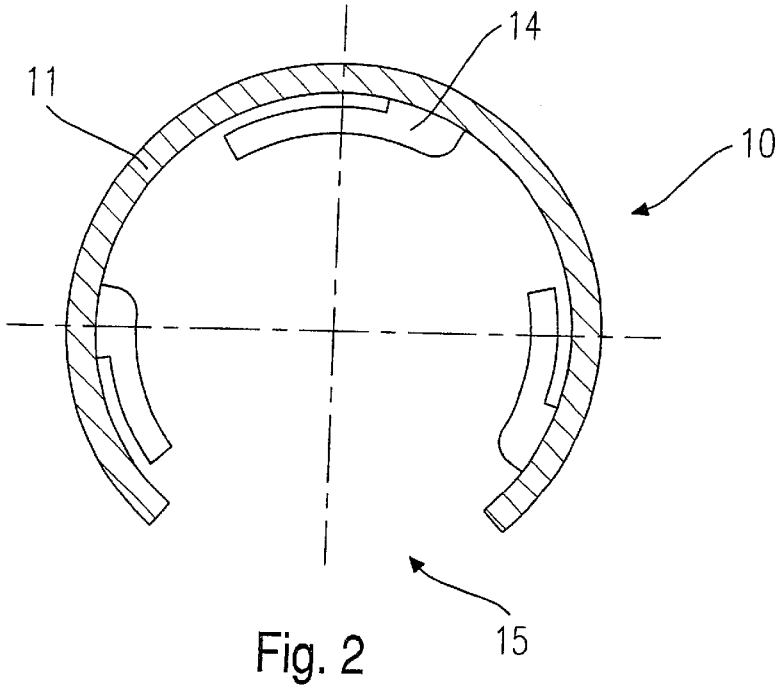
FIG. 2 shows a schematic partial section through the mounting device designed according to the present invention illustrated in FIG. 1, along line II—II in FIG. 1.

FIG. 2 illustrates a schematic partial section through mounting device 10 designed according to the present invention with a view towards fuel injector 1 along line II—II in FIG. 1. Identical components are furnished with consistent reference symbols in all figures.

The section through the end of holding-down sleeve 11 facing shoulder 13 of fuel injector 1 shows three elastic tongues 14 in the exemplary embodiment, which are given the shape shown by stamping out from holding-down sleeve 11 and subsequent bending. The curvature, i.e., the slightly bent shape of elastic tongues 14, is achieved by stamping out sleeve sections which are already arched, as indicated by remaining hole 16 in FIG. 3. The number of elastic tongues 14 is arbitrary and may be designed according to the requirements of mounting device 10. Holding-down sleeve 11 may also be manufactured using a deep-drawing-stamp operation.

Because elastic tongues 14 have a slightly bent shape and rest on shoulder 13 of fuel injector 1 as well as due to the symmetrical system of three elastic tongues 14, which, slightly bent in the direction opposite to the direction of viewing, rest on shoulder 12 of fuel distribution line 4, holding-down sleeve 11 is clamped between fuel injector 1 and fuel distribution line 4 and thus pushes fuel injector 1 into receiving bore 9 of cylinder head 2. Therefore, the contact pressure force may be regulated by an appropriately mounted fuel distribution line 4.

Figure 3:
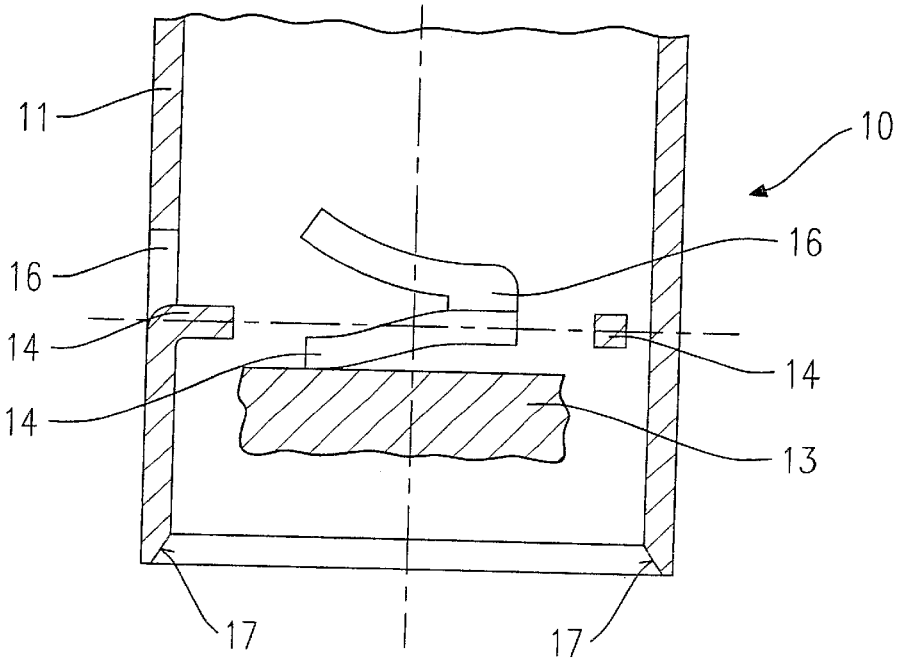
FIG. 3 shows a schematic longitudinal section combined with a schematic partial view through the exemplary embodiment of a mounting device according to the present invention illustrated in FIG. 1.

FIG. 3 shows a schematic longitudinal section with a schematic partial view through the exemplary embodiment of a mounting device 10 according to the present invention illustrated in FIG. 1.

For clarification of the system of elastic tongues 14, holding-down sleeve 11 is illustrated in a sectional view and the area of holding-down sleeve 11, situated opposite the viewer, as well as a section of shoulder 13 of fuel injector 1 on which elastic tongues 14 rest, are added to FIG. 3.

Holes 16, formed by the stamping out and subsequent bending of elastic tongues 14, are clearly recognizable in particular. Elastic tongues 14 are bent into the inside of holding-down sleeve 11 at an angle of approx. 90°. Thereby, the curvature also receives a new position in space. The holding-down effect is thus achieved, resulting in the mutual restraining effect of fuel injector 1 and fuel distribution line 4 together with the system of elastic tongues 14 facing fuel distribution line 4.

Due to the elastic shape of holding-down sleeve 11 it may be ensured that holding-down sleeve 11 rests both on fuel injector 1 and fuel distribution line 4 and thus has a centering effect. Thereby, bending forces on fuel injector 1, which may result in an offset of the valve needle including jamming, may be prevented.

In addition, manufacturing tolerances and length changes due to heating during the operation of the internal combustion engine may be compensated for by the mutual elastic restraint of the components.

The present invention is not limited to the illustrated exemplary embodiment and may be applicable to fuel injectors 1 for injection into the combustion chamber of an auto-igniting internal combustion engine.

What is claimed is:

1. A mounting device for securing a fuel injector in a cylinder head of an internal combustion engine, and also for securing the fuel injector to a fuel distribution line, the mounting device comprising:

a holding-down sleeve including a first end facing the fuel distribution line and a second end facing away from the fuel distribution line;

at least one first elastic tongue bent against a flow direction of the fuel, the at least one first elastic tongue being positioned at the first end of the holding-down sleeve; and at least one second elastic tongue bent in a flow direction of the fuel, the at least one second elastic tongue being positioned at the second end of the holding-down sleeve.

2. The mounting device of claim 1, wherein the fuel distribution line includes a shoulder, and the at least one first elastic tongue of the holding-down sleeve rests on the shoulder of the fuel distribution line and faces the fuel distribution line.

3. The mounting device of claim 1, wherein the fuel injector includes a shoulder, and the at least one second elastic tongue of the holding-down sleeve rests on the shoulder of the fuel injector.

4. The mounting device of claim 1, wherein the holding-down sleeve includes a recess for accommodating an electrical terminal.

5. A method of making the mounting device of claim 1, comprising:

stamping out from a spring steel sheet a component; and one of bending and rolling the component to form the holding-down sleeve.

6. A method of making the mounting device of claim 1, comprising:

manufacturing the holding-down sleeve by deep-drawing.

7. The mounting device of claim 1, wherein the at least one first elastic tongue and the at least one second elastic tongue are integral with the holding-down sleeve.

8. A method of making the mounting device of claim 7, comprising:

stamping out from a spring steel sheet a component; and one of bending and rolling the component to form the holding-down sleeve;

stamping out from the holding-down sleeve and bending the at least one first elastic tongue and the at least one second elastic tongue.

9. The method of claim 8, wherein the at least one first elastic tongue and the at least one second elastic tongue are bent into interior of the holding-down sleeve at an angle of approximately 90 degrees.

10. The mounting device of claim 1, wherein the fuel injector is restrained against the fuel distribution line by the holding-down sleeve.

* * * * *